US008622763B2

(12) United States Patent
Fu et al.

(10) Patent No.: US 8,622,763 B2
(45) Date of Patent: Jan. 7, 2014

(54) CARD EDGE CONNECTOR

(75) Inventors: Xiao-Zhi Fu, Kunshan (CN); Ze-Lin Yao, Kunshan (CN); Xue-Wu Bu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 23 days.

(21) Appl. No.: 13/517,617

(22) Filed: Jun. 14, 2012

(65) Prior Publication Data

US 2012/0322286 A1 Dec. 20, 2012

(51) Int. Cl.
*H01R 13/62* (2006.01)

(52) U.S. Cl.
USPC ..... 439/328; 439/160

(58) Field of Classification Search
USPC ..... 439/327, 328, 567, 160
See application file for complete search history.

(56) References Cited

U.S. PATENT DOCUMENTS

| | | | | |
|---|---|---|---|---|
| 6,200,149 | B1 * | 3/2001 | Chi-Chung | 439/160 |
| 7,121,862 | B2 * | 10/2006 | Tang et al. | 439/327 |
| 2010/0167558 | A1 * | 7/2010 | Guan et al. | 439/65 |
| 2011/0034055 | A1 * | 2/2011 | Yao et al. | 439/329 |
| 2011/0104926 | A1 | 5/2011 | Li et al. | |

* cited by examiner

*Primary Examiner* — Hien Vu
(74) *Attorney, Agent, or Firm* — Wei Te Chung; Ming Chieh Chang

(57) ABSTRACT

A card edge connector (100) includes an insulative housing (1) and a latch retained at one end of the insulative housing (1). The insulative housing (1) includes a mounting slot (16). The latch (3) has a resilience extending portion (311) retained in the mounting slot (16) upwardly. The mounting slot (16) defines a pressing face (112) latching with the extending portion (311) for preventing the extending portion (311) from moving downwardly, thereby the latch (3) could be stably retained on the housing.

8 Claims, 4 Drawing Sheets

CARD EDGE CONNECTOR

BACKGROUND OF THE INVENTION

1. Field of the Invention

The present invention generally relates to a card edge connector and more particularly to a card edge connector with a latch assembled therein.

2. Description of Related Art

U.S. patent application Ser. No. 20110104926 discloses a card edge connector including an iusultive housing, a plurality of contacts retained in the insulative housing and a latch assembled in one side of the insulative housing. The insulative housing includes two opposite side walls, an inserting slot and two end walls located between the two side walls. The end wall includes a mounting slot pass therethrough along an up-to-down direction, a first limiting wall and a second limiting wall located on the outside of the mounting slot and a guiding slot formed between the first and second limiting wall. The second limiting wall has a limiting slot passing therethrough downwardly. The latch includes a base and an inserting portion extending into the mounting slot from the base. The inserting portion includes a vertical plating portion, a connecting portion extending outside from a middle of the plating portion and a limiting portion extending outside from the connecting portion. The plating portion is assembled into the mounting slot along a down-to-up direction, the connecting portion is assembled into the guiding slot along the down-to-up direction. The limiting portion is located in the limiting slot to prevent the latch from moving upwardly. But the latch could be easily move downwardly by the outside force.

Other objects, advantages and novel features of the present invention will become more apparent from the following detailed description of the present embodiment when taken in conjunction with the accompanying drawings.

SUMMARY OF THE INVENTION

The present invention provides a cable connector comprises an insulative housing extending along a left-to-right direction, a plurality of contacts retained in the insulative housing and a latch assembled on one side of the insulative housing. the insulative has a pair of opposite two side walls, inserting face, a mounting face, an inserting slot formed between two side walls and two end walls located in two sides of the inserting slot, one of the end wall having a mounting slot. The latch has a base, a inserting portion extending from the base. The inserting portion having a extending portion extending into the mounting slot upwardly, the mounting slot having at least one pressing face abutting against the extending portion to prevent the extending portion from moving downwardly Other objects, advantages and novel features of the present invention will become more apparent from the following detailed description of the present embodiment when taken in conjunction with the accompanying drawings.

DETAILED DESCRIPTION OF THE INVENTION

Figure 1:
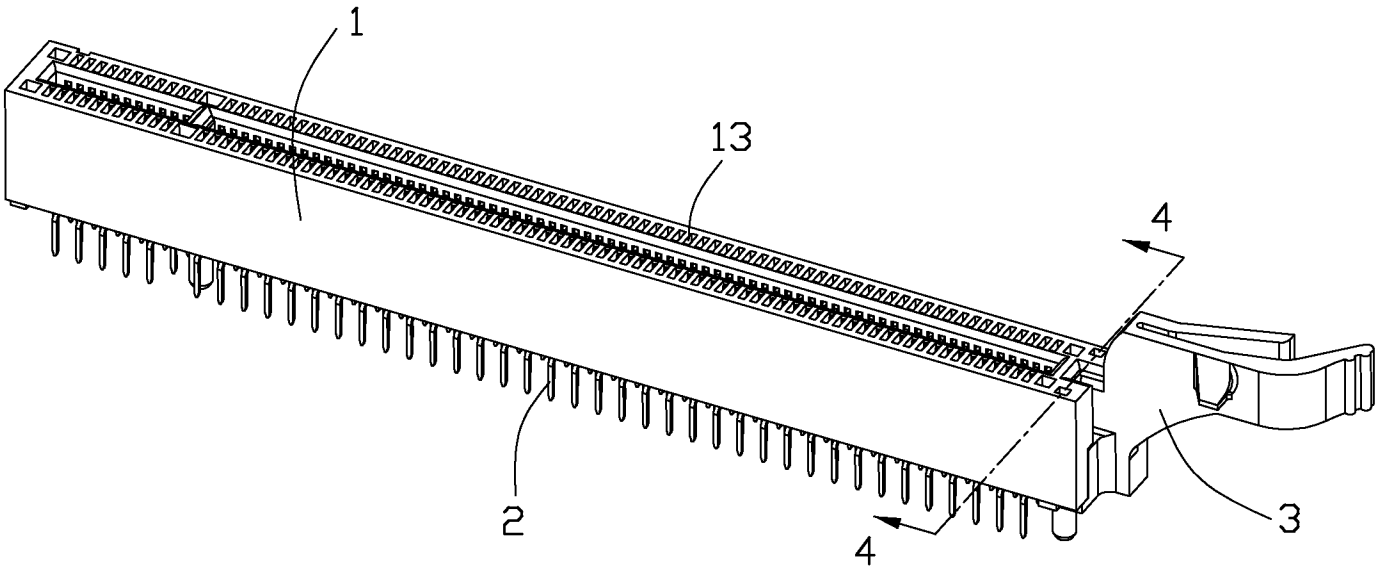
FIG. 1 is an assembled perspective view of a card edge connector according to a preferred embodiment of the present invention.

Reference will now be made to the drawing figures to describe the preferred embodiment of the present invention in detail.

Referring to FIG. 1, a card edge connector 100 includes an insulative housing 1, a plurality of contacts 2 retained in the insulative housing 1 and a latch 3 retained in the insulative housing 1.

Referring to FIGS. 1-4, the insulative housing 1 includes a pair of opposite side walls 11, a middle inserting slot 12 formed between two side walls 11, a plurality of terminal slots 13 depressing from each of the two side walls 11 and communicating with the inserting slot 12 and two end walls 15 located in the two ends of the inserting slot 12. The length direction of the insulative housing 1 is defined as a left-to-right direction and a direction which is vertical with the two side walls 11 is defined as a front-to-rear direction. The insulative housing 1 includes an inserting face 101 mating with a daughter printed circuit board and a mounting face 102 mounting on a mother printed circuit board.

The end wall 15 includes a mounting slot 16 passing through the inserting face 101 and the mounting face 102, two positioning blocks 161 located in the front and rear inner sides of a top of the mounting slot 16, a first limiting wall 17 and a second limiting wall 18 located outside of the mounting slot 16 and separated from each other by a guiding slot 160 formed between the first and second limiting walls 17, 18. Along the left-to-right direction, two positioning blocks 161 is located on an inner side of the first and second limiting walls 17, 18. Two recesses 111 are defined on the end wall 15 and extend downwardly from the inserting face 101 but not passing downwardly through the side walls 11. Along the front-to-rear direction, two positioning blocks 161 are located between the two recesses 111, and a bottom of the recess 111 is below the positioning blocks 161. Bottoms of the recesses 111 are formed with two pressing faces 112 which are parallel with the inserting face 101.

The positioning block 161 is stagger with the pressing face 112 along a height and width direction. The position block 161 is located above the pressing face 112, the pressing faces 112 are located on two sides of the positioning blocks 161 along a front-to-rear direction. The recess 111 is communicated with the mounting slot 16, and a cross section of a space which is formed by the mounting slot 16 and the guiding slot 160 is like a T-sharp. The first and second limiting walls 17, 18 and the guiding slot 160 surround the mounting slot 16 and abreast along a front-to-back direction. A top of the first limiting wall 17 extends to the inserting face 101 and a bottom of the first limiting wall 17 extends to the mounting face 102. A top of the second limiting wall 18 extends to the inserting face 101 and a bottom of the second limiting wall 18 is located above the mounting face 102. So that the height of the second limiting wall 18 is shorter than that of the first limiting wall 17. The bottom of the second limiting wall 18 includes a limiting slot 180 which is communicated with the guiding slot 160 along a front-to-back direction.

Figure 2:
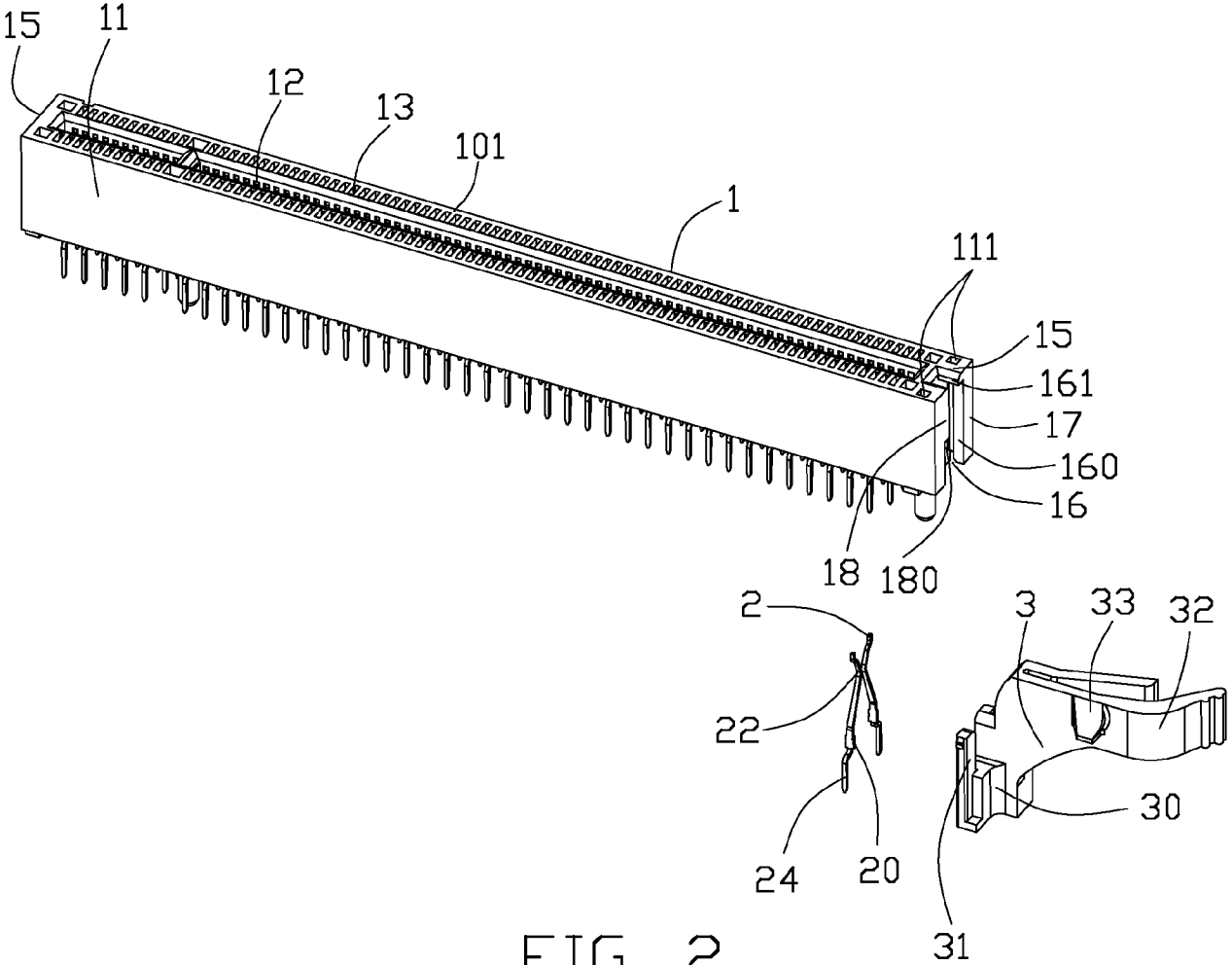
FIG. 2 is an exploded, perspective view of the card edge connector as shown in FIG. 1.
Figure 3:
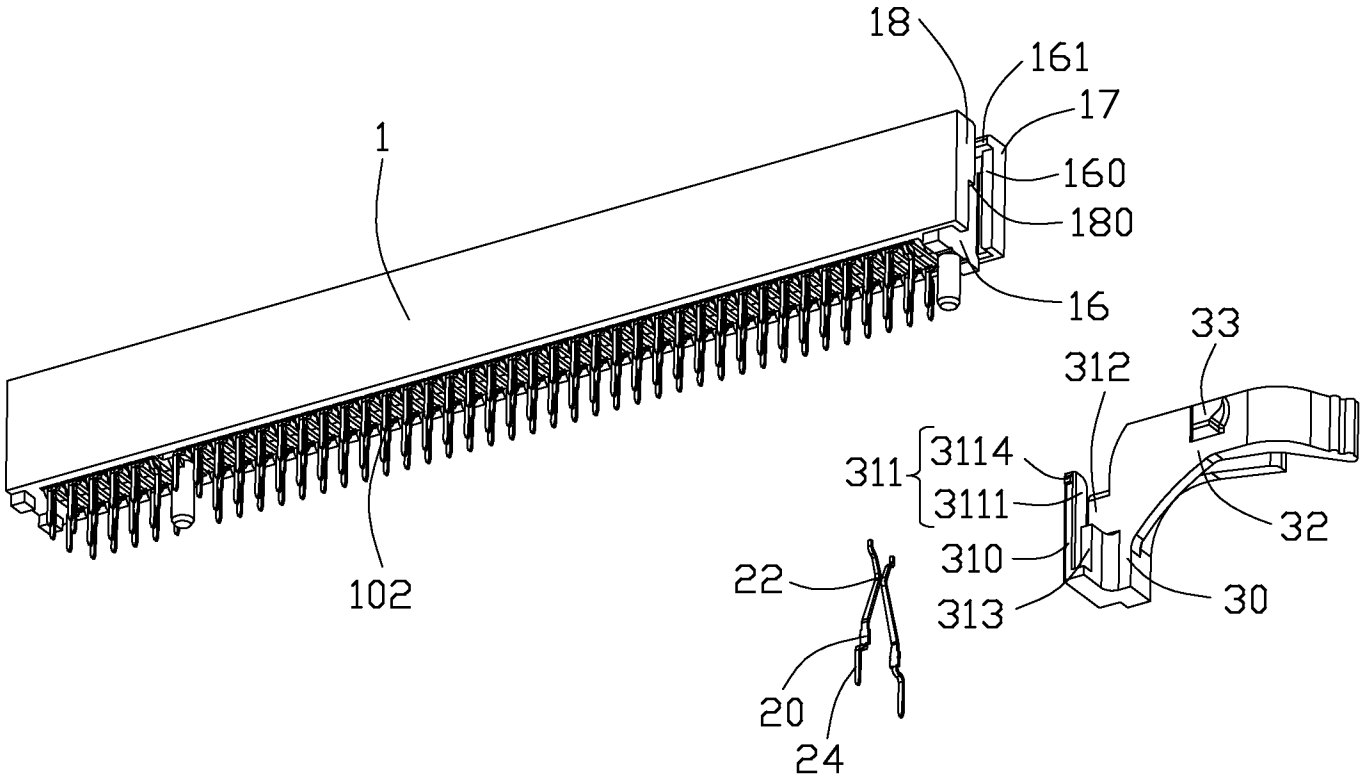
FIG. 3 is another exploded perspective view of the card edge connector as shown in FIG. 1.
Figure 4:
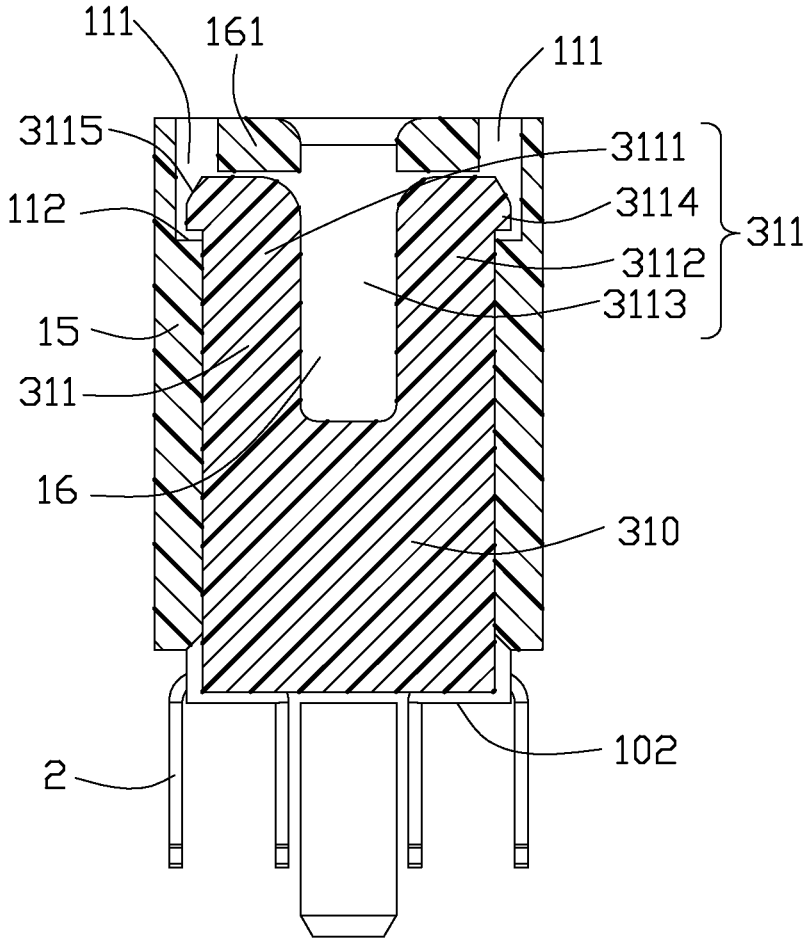
FIG. 4 is a cross-sectional view of the card edge connector taken along line 4-4 of FIG. 1.

Referring to FIGS. 2-3, the contacts 2 are mounted in the terminal slots 13. Each of the contacts 2 includes a retaining portion 20 retained in the terminal slot 13, a contacting portion 21 extending into the inserting slot 12 upwardly from one end of the retaining portion 20 for contacting with the daughter printed circuit board and a soldering portion 24 extending downwardly from another end of the retaining portion 20 for soldering to the mother printed circuit board.

The latch 3 includes a base 30, an inserting portion 31 extending inwardly into the mounting slot 16 from the base 30 and an elastic arm 32 extending outwardly from the base 30 for retaining the daughter printed circuit board. The inserting portion 31 includes a planar portion 310, an extending portion 311 extending upwardly from the planar portion 310, a connecting portion 312 extending outwardly and vertically from a middle of the planar portion 310 and extending along a top to bottom direction and a limiting portion 313 extending outside from a bottom part of the connecting portion 312 and located outside of the planar portion 310. The extending portion 311 includes a first retaining tail 3111 and a second retaining tail 3112 separated from each other, a pressing slot 3113 located between the first and second retaining tails 3111, 3112, and two latching portions 3114 from tops of the first and second retaining tails 3111, 3112. The latching portion 3114 includes a guiding face 3115 to guide the extending portion 3111 inserting into the mounting slot 16. The first and second retaining tails 3111, 3112 can move close to each other. The first and second retaining portions 3111, 3112 are pressed to defect toward each other and then inserted in to the mounting slot 16 along a bottom to up direction. When the first and second retaining tails 3111, 3112 move beyond the pressing faces 112 and elastic recovery, the latching portions 3114 insert into the recesses 111.

The latching portion 3114 has a gap with the recesses 111 along a front-to-back direction. The pressing faces 112 are located under the latching portions 3114 to prevent the latch 3 from moving downwardly. The first and second retaining tails 3111, 3112 are retained in the mounting slot 16, the positioning blocks 16 is located above the extending portions 311 to prevent the extending portions 311 from moving upwardly. The limiting portions 313 abuts against the second limiting walls 18 to prevent the latch 3 from moving upwardly further. Thus, the latch 3 is retained in a right location of the insulative housing 1. The elastic arm 32 includes a convex or locking lug 33 located in an outside thereof. The convex 33 could insert into a notch of the daughter printed circuit board to lock the daughter printed circuit board.

The card edge connector 100 includes a positioning block 161 extending into the mounting slot 16. The latch 3 includes two extending portions 311 which latch with the mounting slot 16 to retain the latch 3. The positioning blocks 161 and pressing faces 112 of the recess 111 prevent the extending portions 311 from moving upwardly or downwardly, respectively. Thereby the latch 3 could be stably retained on the insulative housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector comprising:

an insulative housing extending along a left-to-right direction and having two opposite side walls, an inserting face, a mounting face, an inserting slot formed between the two side walls and two end walls located in two opposite ends of the inserting slot, one end wall having a mounting slot;

a plurality of contacts retained in the insulative housing;

a latch assembled to the insulative housing from a bottom to a top of the mounting slot, the latch having a base, an inserting portion extending inwardly from the base and an elastic arm extending outwardly from the base, the inserting portion having an extending portion inserted into the mounting slot upwardly, the end wall having a pressing face latching with the extending portion to prevent the latch from moving downwardly;

wherein the mounting slot has at least one positioning block on a top thereof, the positioning block is located over the extending portion to prevent the latch from moving upwardly;

wherein the positioning block is stagger with the pressing face along a height and width direction;

wherein the inserting portion has a planar portion connecting with a bottom of the extending portion, the extending portion has a pair of first and second separated retaining tails extending upwardly from the planar portion and two latching portions extending outwardly from tops of the first and second retaining tails, respectively, wherein the latching portion has a guiding face guiding the extending portion inserting into the mounting slot; and wherein the one end wall has a recess depressing downwardly from the inserting face but not downwardly passing therethrough, the recess communicates with the mounting slot and is located closed to the positioning block, the pressing face is located in a bottom of the recess.

2. The card edge connector as claimed in claim 1, wherein the latching portion has a gap with the recess along a front-to-back direction.

3. The card edge connector as claimed in claim 2, wherein the end wall has a first limiting wall, a second limiting wall and a guiding slot formed between the first and second limiting walls and communicating with the mounting slot, a cross section of a space which is formed by the mounting slot and the guiding slot is like a T-sharp.

4. The card edge connector as claimed in claim 3, wherein the first limiting wall extends upwardly to the inserting face and extending downwardly to the mounting face, the second limiting wall extends upwardly to the inserting face, a bottom of the second limiting wall is located above the mounting face, the inserting portion includes a limiting portion abutting against the second limiting portion upwardly.

5. A card edge connector comprising:

an insulative housing having an inserting slot for receiving a daughter board and a mounting slot located on one end of the inserting slot, the mounting slot having two positioning blocks at a top thereof and two pressing faces below the positioning block;

a plurality of contacts retained in the insulative housing, the contact includes a contacting portion extending into the inserting slot and a soldering portion extending out of the insulative housing;

a latch having an inserting portion inserted into the mounting slot along a bottom to upper direction, the inserting portion having an extending portion, and at least a part of the inserting portion located between the positioning block and pressing face to prevent the extending portion from moving upwardly or downwardly;

wherein the positioning block is stagger with the pressing face along a height and width direction;

wherein the inserting portion has a planar portion connecting with a bottom of the extending portion, the extending portion has a pair of first and second separated retaining tails extending upwardly from the planar portion and two latching portions extending outwardly from tops of the first and second retaining tails, respectively; and wherein the latching portion has a guiding face guiding the extending portion inserting into the mounting slot.

6. A card edge connector for use with a module, comprising:

an insulative housing defining an elongated receiving slot along a lengthwise direction for receiving said module;

a plurality of contacts disposed in the housing with contacting sections extending into the receiving slot;

a mounting slot formed at one end of the housing in the lengthwise direction, said mounting slot communicating with an exterior outwardly in the lengthwise direction and downwardly in a vertical direction perpendicular to said lengthwise direction;

a latch discrete from the housing and assembled to the housing, said latch defining a base, an elastic arm extending outwardly essentially along the lengthwise direction with thereon a locking lug for locking into a notch of said module, an inserting portion extending from the base and received in the mounting slot, a latching portion formed on the inserting portion to latch to the housing for preventing downward movement of the latch;

wherein the inserting portion and the associated latch are hidden in the housing for providing a good-looking appearance of the whole connector;

wherein housing provides an at least partially upward pressing face to engage the latching portion thereto;

wherein the housing and the latch uses different material under condition that that of the latch is softer than that of the housing;

wherein the housing further provides a downward pressing face to engage the latch for preventing upward movement of the latch; and wherein said upward pressing face is located around an upper region of the housing while the downward pressing face is located around a lower region of the housing.

7. The card edge connector as claimed in claim 6, wherein said upward pressing face upwardly communicates with an exterior for injection molding consideration of the housing.

8. The card edge connector as claimed in claim 6, wherein the housing provides a positioning block to hide the inserting portion thereunder while upwardly exposing the latching portion for injection molding consideration of the housing.

* * * * *